US010315240B2

(12) United States Patent
Masai et al.

(10) Patent No.: US 10,315,240 B2
(45) Date of Patent: Jun. 11, 2019

(54) PUNCHING PROCESSING METHOD, METHOD OF MANUFACTURING PRESS-FORMED PRODUCT, AND PRESS-FORMED PRODUCT

(71) Applicant: JX Nippon Mining & Metals Corporation, Tokyo (JP)

(72) Inventors: Kazutaka Masai, Ibaraki (JP); Hironori Imamura, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 9 days.

(21) Appl. No.: 15/555,593

(22) PCT Filed: Feb. 22, 2016

(86) PCT No.: PCT/JP2016/055087

§ 371 (c)(1),
(2) Date: Sep. 5, 2017

(87) PCT Pub. No.: WO2016/143495

PCT Pub. Date: Sep. 15, 2016

(65) Prior Publication Data

US 2018/0036785 A1 Feb. 8, 2018

(30) Foreign Application Priority Data

Mar. 6, 2015 (JP) ..... 2015-045110

(51) Int. Cl.
*B21D 28/16* (2006.01)
*B21D 28/26* (2006.01)
*B21D 19/00* (2006.01)

(52) U.S. Cl.
CPC ..... *B21D 28/16* (2013.01); *B21D 19/005* (2013.01); *B21D 28/26* (2013.01); *B21D 28/265* (2013.01)

(58) Field of Classification Search
CPC ..... B21D 28/08; B21D 28/12; B21D 28/16; B21D 28/24; B21D 28/243; B21D 28/26; B21D 19/005
See application file for complete search history.

(56) References Cited

U.S. PATENT DOCUMENTS

2004/0169069 A1* 9/2004 Ostini ..... B21D 28/12 234/109
2009/0090156 A1 4/2009 Nakajima et al.

FOREIGN PATENT DOCUMENTS

CN 101862785 A 10/2010
CN 103934358 A 7/2014
(Continued)

OTHER PUBLICATIONS

EPO Google Translation JPH09134987, Sep. 2018.*
(Continued)

*Primary Examiner* — Pradeep C Battula
(74) *Attorney, Agent, or Firm* — Marshall, Gerstein & Borun LLP

(57) ABSTRACT

The punching processing method of the present invention is a punching processing method in which a metallic sheet material 1*a* is sequentially subjected to multiple punching processing steps by a punch and a die, comprising, in first step punching processing, forming a first step punched surface 2 on the sheet material 1*a*, and then in second step punching processing, forming a second step punched surface 3 on the sheet material 1*a* by punching the sheet material 1*a* such that the second step punched surface 3 and the first step punched surface 2 are crossed with each other, thereby forming matching portions 5 at positions where the first step punched surface 2 and the second step punched surface 3 intersect, wherein after the first step punching processing and before the second step punching process, the method further comprises subjecting the sheet material 1*a* to swag-
(Continued)

(a)

(b)

ing processing that sandwiches and crushes matching portion forming portions 5*a* of the sheet material 1*a*, which will form the matching portions 5, from a top surface TS side and a back surface BS side of the sheet material 1*a*.

5 Claims, 9 Drawing Sheets

(56) References Cited

FOREIGN PATENT DOCUMENTS

| | | | |
|---|---|---|---|
| JP | 62259625 | | 11/1987 |
| JP | 8-64738 | | 3/1996 |
| JP | 08257646 | | 10/1996 |
| JP | 9-134987 | | 5/1997 |
| JP | 2001-259755 | A | 9/2001 |
| JP | 2001321867 | | 11/2001 |
| WO | WO-2009/041217 | A1 | 4/2009 |

OTHER PUBLICATIONS

International Preliminary Report on Patentability for PCT/JP2016/055087 dated Sep. 12, 2017 (English translation).
Search Report in International Application No. PCT/JP2016/055087 dated May 17, 2016, 2 pages.
Office Action in CN Application No. 201680013837.7 dated Jul. 12, 2018, 14 pages.
Search Report in EP Application No. 16761467.6 dated Oct. 22, 2018, 8 pages.

* cited by examiner

[FIG. 1]
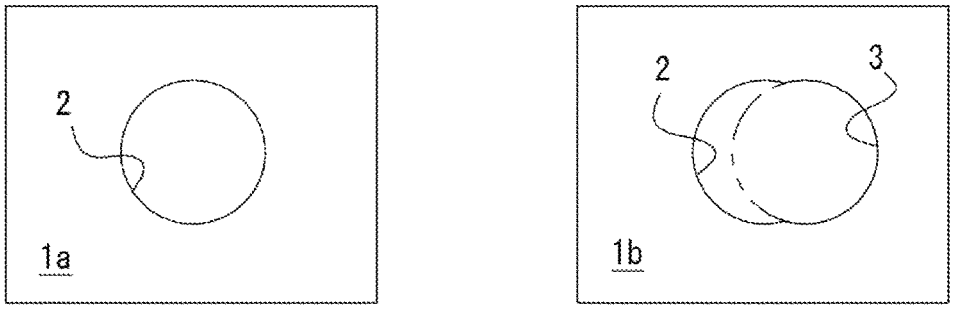
(a) (b)

[FIG. 2]
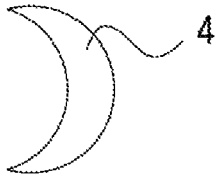

[FIG. 3]
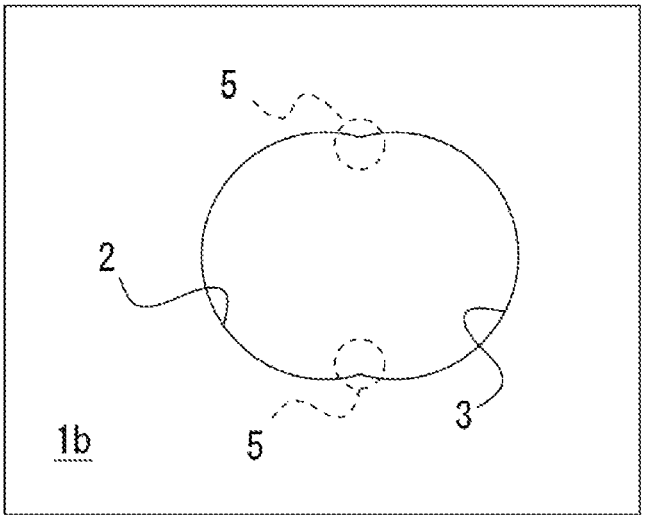

[FIG. 4]
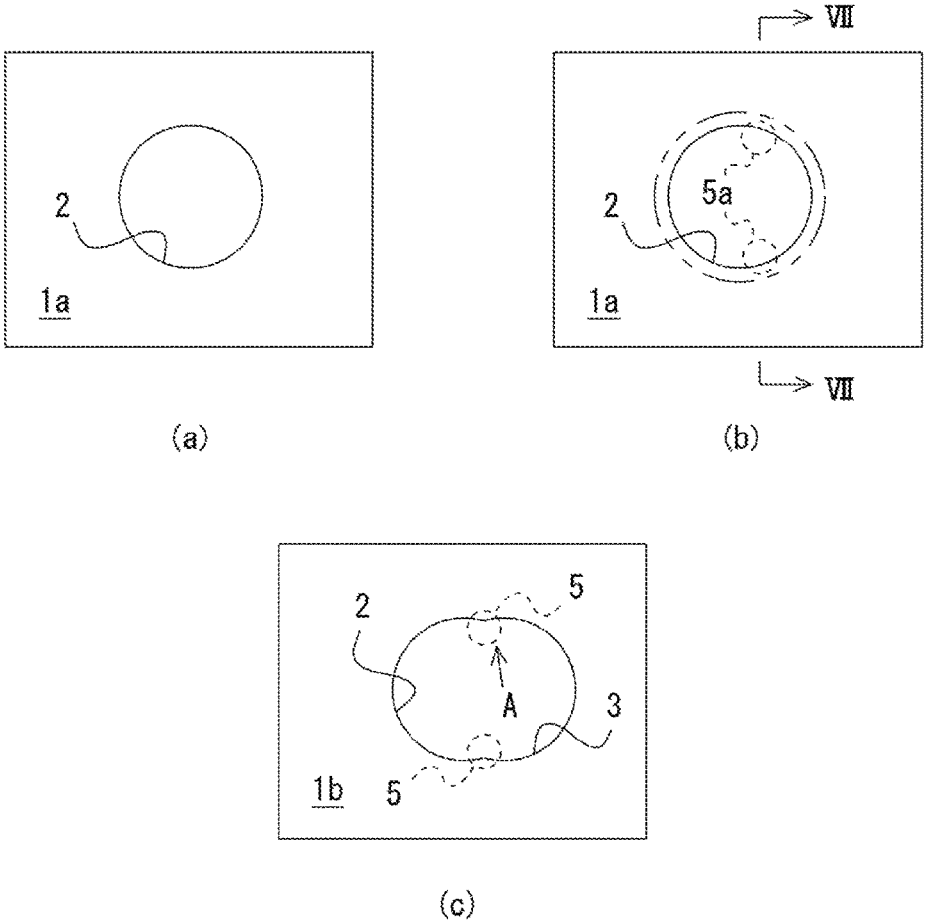

[FIG. 5]
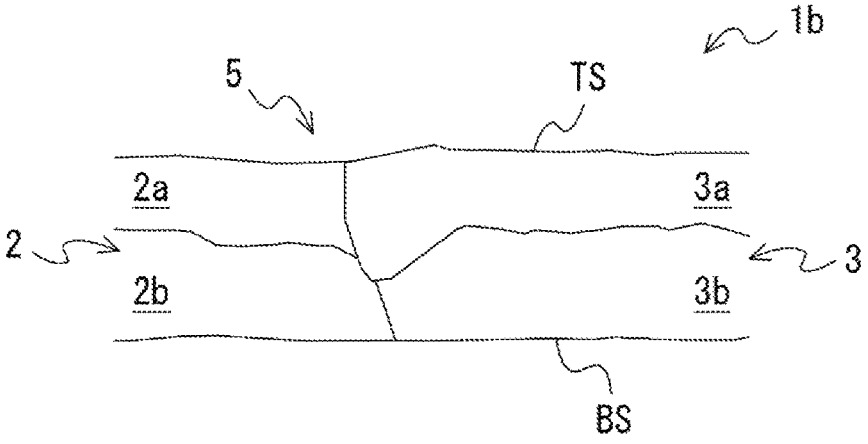

[FIG. 6]
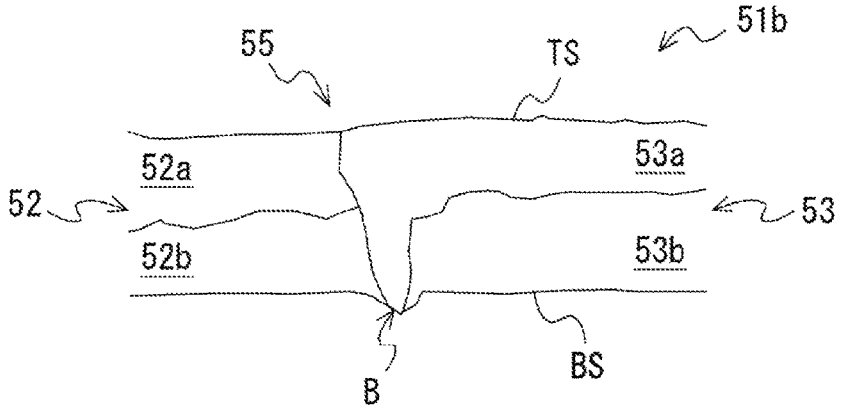

[FIG. 7]
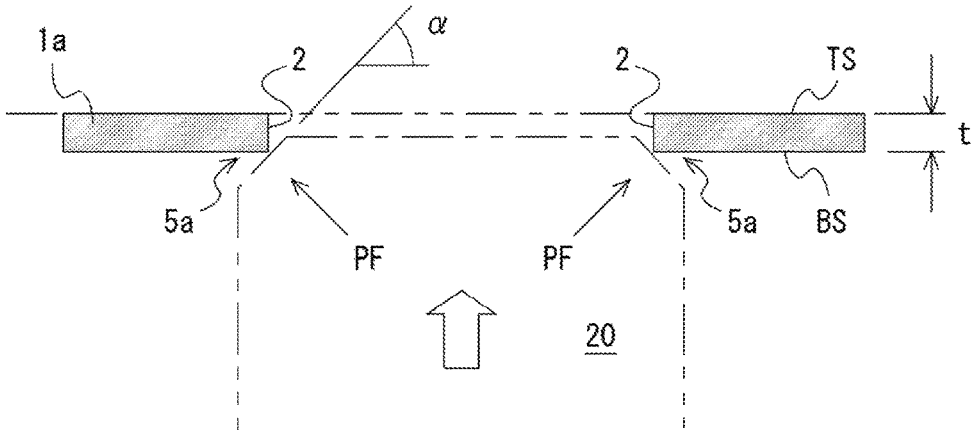

[FIG. 8]
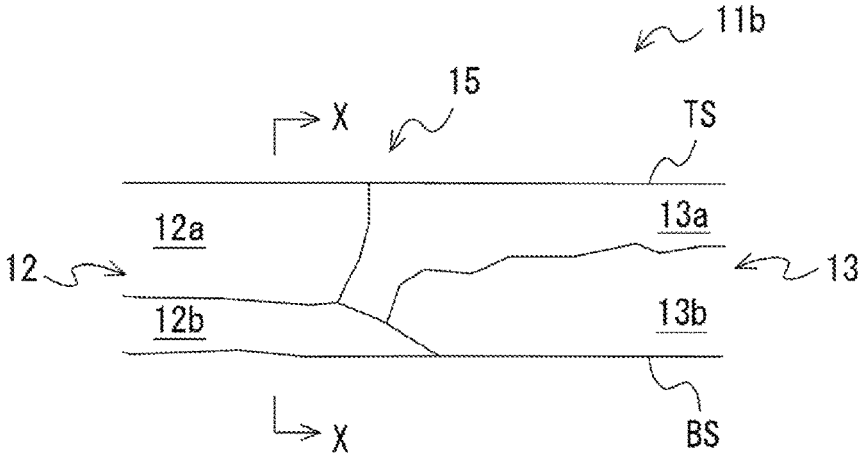

[FIG. 9]
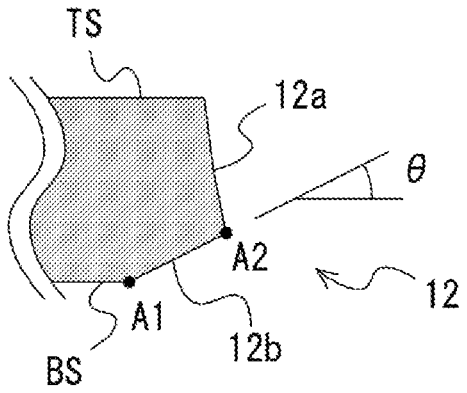

PUNCHING PROCESSING METHOD, METHOD OF MANUFACTURING PRESS-FORMED PRODUCT, AND PRESS-FORMED PRODUCT

TECHNICAL FIELD

This invention relates to a punching processing method in which a metallic sheet material is sequentially subjected to multiple punching processing steps by means of a punch(s) and a die(s), for example in a progressive press mold, a method of manufacturing a press-formed product, and a press-formed product. More particularly, the present invention proposes to a technique capable of suppressing formation of burrs at positions where respective punched surfaces formed in the sheet material intersect with each other, and suppressing generation of metal powder at the positions, by the multiple punching processing steps.

BACKGROUND ART

Connector terminals are generally manufactured by high speed pressing using a progressive mold.

In such a progressive mold, the connector terminals or other press-formed products are manufactured, for example, via a punching step of subjecting a long stripped metallic sheet material to punching processing inside the mold while intermittently feeding the sheet material in one direction, to punch out a predetermined shape profile, followed by steps of subjecting the punched material to imposition processing and bending processing as required.

SUMMARY OF THE INVENTION

Problem to be Solved by the Invention

In the above punching step, it is difficult to punch a complex shape profile having corner portions, such as a terminal shape and the like, from the sheet material, by single punching processing. Therefore, the punching processing is carried out in a plurality steps, through which the sheet material is finally formed into a desired shape profile.

When the punching processing is thus carried out at a plurality of steps, in one punching processing step, a surface to be punched may be crossed with a punched surface already formed in the sheet material in a previous punching processing step and the punching may be then carried out. In this case, the respective punched surfaces formed by the previous first step punching processing and the subsequent second step punching processing are located adjacent to each other, so that so-called matching portions will be formed at the crossed portions of these punched surfaces.

The matching portions cause problems that large burrs protruding on the top surface side or the back surface side of the sheet material will tend to be formed, and defects due to beard burrs with the burrs staring to peeling off will occur and metal powder due to peeling off of the burrs will be generated. Regardless of the presence or absence of burrs, the metal powder tends to be generated at the matching portions as stated above, and the generated metal powder is caught between the material and the mold to cause a scratch defect that will form impression or other various defects of molded products.

No effective solution strategy has been established for the problems of burrs or metal powder at the matching portions, and a shape to be punched or order of the punching processing has generally been improved such that it is difficult to generate the burrs or metal powder at a designing stage of the mold. Therefore, it may provide design limitations. Further, if a problem is found after completion of the mold, large-scale mold modification is required for solving the problem. This is often addressed by cleaning the interior of the mold, which causes reduction of an operation rate of the press.

An object of the present invention is to solve such problems. One object of the present invention is to provide a punching processing method that can effectively suppress the generation of burrs at the matching portions formed by the multiple punching processing steps, and the generation of metal powder at the matching portions, and a method of manufacturing a press-formed product using the same, as well as a press-formed product.

Means for Solving the Problem

As a result of intensive studies in order to solve the above problems, the inventors have found that, between respective punching processing steps for forming a first step punched surface and a second step punched surface among the multiple punching processing steps, swaging processing for at least crushing portions where the matching portions will be formed is carried out near the first step punched surface of the sheet material, so that the generation of burrs at the matching portions and the generation of metallic powder can be suppressed.

Based on such findings, the present invention provides a punching processing method in which a metallic sheet material is sequentially subjected to multiple punching processing steps by a punch and a die, comprising, in first step punching processing, forming a first step punched surface on the sheet material, and then, in second step punching processing, forming a second step punched surface on the sheet material by punching the sheet material such that the second step punched surface and the first step punched surface are crossed with each other, thereby forming one or more matching portions at positions where the first step punched surface and the second step punched surface intersect, wherein after the first step punching processing and before the second step punching process, the method further comprises subjecting the sheet material to swaging processing that sandwiches and crushes matching portion forming portions of the sheet material, which will form the matching portions, from a top surface side and a back surface side of the sheet material.

Here, when pressing the top surface side of the sheet material by the punch in the second step punching processing, the swaging processing performed before the second step punching processing may be preferably carried out by pressing and crushing the matching portion forming portions of the sheet material from the back surface side opposite to the top surface side of the sheet material.

In this case, the swaging processing may be preferably carried out by pressing and crushing one or more boundary portions between the back surface and the first step punched surface at the matching portion forming portions by an inclined contact surface inclined at 30° to 85° relative to the top surface and the back surface of the sheet material.

Further, the swaging processing may be preferably carried out with a processing rate in a range of 30% to 90% relative to the thickness direction of the sheet material. Here, the processing rate is represented by a ratio of the thickness of the matching portion forming portion whose thickness has been decreased after the swaging processing to the thickness of the matching portion forming portion before the swaging processing.

Further, a method of manufacturing a press-formed product of the present invention uses any one of the punching processing methods as described above.

Furthermore, a press-formed product of the present invention is manufactured by the manufacturing method as described above.

Effect of the Invention

According to the method of the present invention, the swaging processing can be carried out after the first step punching processing and before the second step punching processing by sandwiching and crushing the matching portion forming portions of the sheet material from the top surface side and the back surface side of the sheet material, thereby adjusting properties of the first step punched surface at the matching portion forming portions of the first step punched surface, so that the generation of burrs can be effectively suppressed at the matching portions formed by the subsequent second step punching processing. In addition, the generation of metal powder due to peeling off of burrs or the like can also be suppressed. Further, according to the method of the present invention, the problems of burrs and metal powder at the matching portions can be addressed without large-scale modification of the mold, so that practical use will be facilitated.

BRIEF DESCRIPTION OF THE DRAWINGS

FIG. 1 is plan views of sheet materials showing an example where a sheet material is subjected to multiple punching processing steps.

FIG. 2 is a plan view of a scrap discharged in a second step punching processing of the punching processing steps in FIG. 1.

FIG. 3 is a plan view showing a press-formed product after the punching processing steps in FIG. 1.

FIG. 4 is plan views of sheet materials showing the punching processing method according to one embodiment of the present invention.

FIG. 5 is a view of the portion shown by the arrow A of FIG. 4(*c*).

FIG. 6 is a view similar to FIG. 5, showing a matching portion of a press-formed product molded by a conventional method.

FIG. 7 is an enlarged cross-sectional view taken along the line VII-VII in FIG. 4(*b*).

FIG. 8 is a view similar to FIG. 5, showing a matching portion of a press-formed product molded by a method of another embodiment.

FIG. 9 is a cross-sectional view taken along the line X-X in FIG. 8.

MODES FOR CARRYING OUT THE INVENTION

Hereinafter, embodiments of the present invention will be described in detail with reference to the drawings.

In the punching processing method according to one embodiment of the present invention in which a metallic sheet material is sequentially subjected to multiple punching processing steps by a punch(s) and a die(s), first of all, a first step punched surface and a second step punched surface intersecting with the first step punched surface are respectively formed by a first step punching processing and a second step punching processing that is carried out after the first step punching processing and in a direction intersecting with the direction of the first step punching processing among the multiple punching processing steps, and corner portions called matching portions are formed at positions where the first step punched surface and the second step punched surface intersect.

In addition, it is of course possible to carry out other punching processing or other processing before the first stage punching processing or after the second step punching processing, as well as it is also possible to carry out other processing between the first step punching processing and the second step punching processing.

The punching method of the present invention can be effectively employed in high speed pressing for forming a sheet material into a predetermined shape by subjecting the sheet material to the multiple punching processing steps while intermittently feeding the sheet material in one direction mainly in a progressive press mold, and optionally imposition processing or bending processing, for example in order to manufacture a connector terminal or the like. Here, for the sake of simplicity, FIG. 1 illustrates an embodiment where the sheet material in a stationary state is subjected to punching processing for forming a circular shape as viewed from the plane at two stages with the position of the sheet material shifted.

FIG. 1(*a*) shows a sheet material 1*a* after the first step punching processing that punches the sheet material sandwiched between a punch and a die (which are not shown) into a circular shape as viewed from the plane by the punch.

By the first step punching processing, a first step punched surface 2 drawing a circular shape as viewed from the plane is formed around a disc-shaped void formed by cutting out the sheet material 1*a*.

The above sheet material 1 is then subjected to the second step punching processing that punches the sheet material at a position somewhat shifted from the first step punched surface 2 to the right side in FIG. 1(*a*) so as to intersect with the first step punching processing, by the punch having the same size and shape, as shown by an imaginary lines in FIG. 1(*b*)

The second step punching processing provides a press-formed product having a second step punched surface 3 with the same circular arc shape as that of the first step punched surface 2 as viewed from the plane, which is adjacent and contiguous to the first step punched surface 2, as shown in FIG. 1(*b*). As shown in FIG. 2, a scrap 4 discharged in the second step punching processing has a falcate contour shape as viewed from the planner.

When such two punching processing steps are carried out, matching portions 5 as corner portions slightly protruding toward the void side will be formed in the press-formed product 1*b* at positions where the first step punched surface 2 and the second step punched surface 3 intersect, as shown in an enlarged plan view of FIG. 3. In the illustrated example, the first step punched surface 2 and the second step punched surface 3 intersect at two upper and lower positions in FIG. 3, and two matching portions 5 are formed at the positions, respectively.

It is widely known in the art that the matching portions 5 cause molding defects such as the generation of burrs protruding toward the top surface side or the back surface side of the press-formed product 1*b* and the generation of metal powder resulting from peeling off of the burrs. Specifically, during the second step punching processing, the portions close to the punch for the second step punching processing on the first step punched surface 2 formed by the first step punching processing would be accompanied by the portion to be punched (the scrap 4) with the punch and plastically deformed to form burrs protruding toward the top surface side or the back surface side, and the portions plastically deformed and protruded would be scraped by the punch for the second step punching processing, thereby generating metal powder.

In order to prevent the generation of burrs or metal powder at the matching portions 5, in this embodiment, the sheet material 1*a* is subjected to swaging processing after the first step punching processing and before the second step punching processing, as shown in FIG. 4.

More particularly, after forming the first step punched surface 2 in the sheet material 1*a* by the first step punching processing and before performing the second step punching processing, the swaging processing is carried out by sandwiching and crushing at least portions where the first step punched surface 2 and the second step punched surface 3 to be formed by the second stage punching processing will intersect, that is, matching portion forming portions 5*a* where the matching portions 5 will be formed after the second step punching processing, from the top surface side and the back surface side of the sheet material 1*a*. In this embodiment, not only the matching portion forming portions 5*a* but also the entire edge portion facing the void including the first step punched surface 2 are pressed and crushed, as shown by an imaginary line in FIG. 4(*b*).

After the swaging processing, the second step punching processing can be carried out in the same manner as described above, thereby forming the first step punched surface 2 and the second step punched surface 3 having good surface properties at the matching portions 5, as illustrated in FIG. 5.

As can be seen from FIG. 5, the first step punched surface 2 and the second step punched surface 3 are comprised of two layers: shear surface regions 2*a*, 3*a* located on a top surface TS side of the press-formed product 1*b* and fracture surface regions 2*b*, 3*b* located on a back surface BS side, respectively. The shear surface regions 2*a*, 3*a* and the fracture surface regions 2*b*, 3*b* are arranged side by side to extend in the longitudinal direction (the left-right direction in FIG. 5) of the first step punched surface 2 and the second step punched surface 3.

In general, the shear surface region would be formed by rubbing against the punch or the die when the sheet material is stretched in the thickness direction by punching processing to form a smooth surface having some linear patterns in the thickness direction. On the other hand, the fracture surface region would be generated by being torn off from the scrap discharged after being stretched by punching processing to form a dimple-like surface having irregularities thereon, which is clearly different from the shear surface region.

According to this embodiment, the shear surface region 3*a* on the top surface TS side of the second step punched surface 3 gradually expands toward the fracture surface region 3*b* side as approaching the matching portion 5 in the longitudinal direction, and has longer length in the thickness direction (the up-down direction in FIG. 5) at the matching portion 5 than the length of the other portions, but it does not expand toward the fracture surface region 3*b* to reach the back surface BS side and is present within the second step punched surface 3, as shown in FIG. 5. The burrs at the matching portions are usually generated due to the shear surface area extending toward the fracture surface area side beyond the back surface and protruding from the back surface. In this embodiment, however, such burrs are not generated.

In addition, FIG. 6 shows a press-formed product 51*b* molded by a conventional method in which two punching processing steps are similarly carried out with the exception that the swaging processing as stated above is not carried out, as a view similar to FIG. 5. As clearly shown in FIG. 6, the press-formed product 51*b* obtained by the conventional method has a burr B protruding from the back surface BS, because the shear surface region 53*a* of the second step punched surface 53 formed by the second step punching processing widely expands toward the fracture surface area 53*b* side beyond the back surface BS at the matching portion 55.

Here, in the present invention, if the sheet material 1*a* is to be punched by pressing the punch from the top surface TS side of the sheet material 1*a* in the second step punching processing, it is preferable that in the above-mentioned swaging processing previously performed, the sheet material 1*a* is pressed and crushed from the back surface BS side opposite to the top surface TS of the sheet material 1*a* by a pressing member 20 or the like that is the swaging processing means indicated by an imaginary line in FIG. 7, as shown in the enlarged cross sectional view including the matching portion forming portion 5*a* in FIG. 7.

The back surface BS side of the matching portion forming portion 5*a* of the sheet material 1*a* is thus pressed and crushed, so that by pressing the punch from the top surface TS side of the sheet material 1*a* in the subsequent second step punching processing, the expansion of the shear surface region 3*a* toward the fracture surface region 3*b* located on the back surface BS side at the formed matching portion 5 of the second step punched surface 3 can be suppressed and the generation of burrs at the matching portion 5 can be more reliably and effectively prevented.

Although not shown, if the sheet material is punched by pressing the punch from the back surface side of the sheet material in the second step punching processing in contrast to the foregoing, it is preferable that in the swaging processing, the matching portion forming portion is pressed and crushed by the pressing member from the top surface side of the sheet material. In other words, it is preferable that in the swaging processing, the matching portion forming portion is pressed by the pressing member from the opposite side to the side where the punch is pressed in the second step punching processing. The matching portion forming portion may also be pressed from both sides of the top surface side and the back surface side by the pressing member.

Here, when the matching portion forming portion 5*a* of the sheet material 1*a* is pressed and crushed by the swaging processing, the matching portion forming portion 5*a* may be preferably pressed in a direction inclined relative to the thickness direction of the sheet material 1*a*, rather than in a direction parallel to the thickness direction.

As can be seen from FIG. 7, the contact surface of the pressing member 20 of the swaging processing means with the matching portion forming portion 5*a* may be inclined at a predetermined inclination angle $\alpha$ relative to the top surface TS or the back surface BS of the sheet material 1*a*. As a result, the pressing member 20 is displaced along the thickness direction as indicated by a void arrow in FIG. 7, and when the sheet material 1*a* is pressed by the pressing member 20, pressing force PF is applied particularly to a boundary portion between the back surface BS and the first step punched surface 2 at the matching portion forming portion 5*a* in the pressing direction where the above inclined contact surface of the pressing member 20 is inclined relative to the thickness direction. Consequently, at the crushed matching portion forming portion 5*a*, a shape conforming to the inclined contact surface of the pressing member 20 is formed at the boundary portion between the back surface BS and the first step punched surface 2.

In this embodiment, the fracture surface regions 2*b*, 3*b* are then inclined at a predetermined angle θ relative to the back surface BS at the matching portion 5 of the press-formed product 1*b* after the second step punching processing, and expansion of the shear surface regions 2*a*, 3*a* toward the fracture surface regions 2*b*, 3*b* side at the matching portion 5 can be suppressed to prevent the generation of burrs at the matching portion 5.

The inclined contact surface of the pressing member 20 of the swaging processing means in contact with the matching portion forming portion 5*a* may have a flat surface shape as shown in FIG. 7, as well as a curved surface shape projecting outwardly or a curved surface shape recessed inwardly, although not shown.

Further, when the pressing member 20 of the swage processing means is displaced as indicated by a void arrow in FIG. 7 and crush the sheet material 1*a*, the pressing member can be displaced in a predetermined amount of displacement from a position where the pressing member 20 is in contact with the sheet material 1*a* to a position where the displacement is stopped. The above amount of displacement herein can be preferably controlled such that a processing rate which is a ratio of the thickness of the matching portion forming portion 5*a* whose thickness has decreased after completion of the swaging processing relative to the thickness t of the matching portion forming portion 5*a* of the sheet material 1*a* before the swaging processing is from 15% to 90%. More preferably, the processing rate may be 30% to 85%.

The adjustment of the inclination angle α of the inclined contact surface in the swaging processing can lead to a press-formed product 11*b* having a small angle θ between the back surface BS and the fracture surface region 12*b* on the side of the first step punched surface 12 at the matching portion 15, and the like, for example as illustrated in FIG. 8. In this press-formed product 11*b*, the angle θ between the back surface BS and the fracture surface region 12*b* at the matching portion 15 is smaller than that shown in FIG. 5, as shown in the cross-sectional view of the first step punched surface 12 in FIG. 9.

In order to adjust such an angle θ, the inclination angle α of the inclined contact surface in the swaging processing may be, for example, 30° to 85°, because the generation of burrs and the generation of metal powder at the matching portion 15 of the press-formed product 11*b* to be manufactured can be prevented more reliably.

Further, the angle θ between the back surface BS and the fracture surface region 12*b* on the first step punched surface 12 side at the matching portion 15 may be preferably 30° to 85°. This angle θ coincides with the inclination angle α of the inclined contact surface of the pressing member 20 in the swaging processing. Measurement of the angle θ can be performed by measuring an angle at which a straight line connecting a point A1 where the fracture surface region 12*b* of the first step punched surface 12 near the matching portion 15 subjected to the swaging processing intersects with the back surface BS and a point A2 where the fracture surface region 12*b* intersects with the shear surface region 12 is inclined relative to the back surface B, as viewed in the cross section shown in FIG. 9.

EXAMPLE

The punching processing method of the present invention was experimentally conducted and its effects were confirmed as described below. However, the description herein is for the purpose of illustration only and is not intended to be limited thereto.

A test was conducted by subjecting the sheet material to the two punching processing steps with the processing position shifted, using the punch having the circular shape as viewed from the plane, as stated above. Since the degree of shifting greatly affected the generation of burrs at the matching portions, the test was carried out with a fixed degree of shifting.

In Examples 1 to 9, the swaging processing was performed between the two punching processing steps under the conditions shown in Table 1. Here, in Examples 1 and 2, the same surface side as the surface pressed by the punch in the second step punching processing was pressed and crushed in the swaging processing before the second step punching processing. On the other hand, in Examples 3 to 7, the side opposite to the surface pressed by the punch in the second step punching processing was crushed in the swaging processing. In Examples 8 and 9, the top surface side and the back surface side were simultaneously pressed and crushed in the swaging processing.

However, in Comparative Example 1, the swaging processing was not performed. In Comparative Examples 2 and 3, the swaging processing was performed after performing the two punching processing steps under each condition shown in Table 1.

In the column of "Presence or Absence of Burrs" in Table 1, the symbol "◎" indicates that the burrs were sufficiently small or no formation of burrs was observed, whereas the symbol "×" indicates that large burrs protruding on the top surface side or back surface side of the press-formed product were formed. Also, in the column of "Metal Powder", the symbol "◎" indicates that a little amount of metal powder was generated, whereas the symbol "×" indicates that a large amount of metal powder was generated.

TABLE 1

| | Swaging Processing | | | | Results | |
|---|---|---|---|---|---|---|
| | Timing of implementation | Surface Pressed by Pressing Member | InclinationAngle θ (°) of Inclined Contact Surface | Processing Rate (%) | Presence or Absence of Burrs | Metal Powder |
| Example 1 | Between First and Second Punching Steps | Top Surface | 30 | 30 | Δ | Δ |
| Example 2 | Between First and Second Punching Steps | Top Surface | 63 | 70 | Δ | ○ |
| Example 3 | Between First and Second Punching Steps | Back Surface | 30 | 30 | ○ | ◎ |
| Example 4 | Between First and Second Punching Steps | Back Surface | 60 | 50 | ◎ | ◎ |

TABLE 1-continued

| | Swaging Processing | | | | Results | |
|---|---|---|---|---|---|---|
| | Timing of implementation | Surface Pressed by Pressing Member | InclinationAngle θ (°) of Inclined Contact Surface | Processing Rate (%) | Presence or Absence of Burrs | Metal Powder |
| Example 5 | Between First and Second Punching Steps | Back Surface | 15 | 50 | ◎ | ◎ |
| Example 6 | Between First and Second Punching Steps | Back Surface | 85 | 50 | ◎ | ◎ |
| Example 7 | Between First and Second Punching Steps | Back Surface | 60 | 80 | ◎ | ◎ |
| Example 8 | Between First and Second Punching Steps | Both Surfaces | Top Surface Side: 30 Back Surface Side: 24 | 20 | Δ | Δ |
| Example 9 | Between First and Second Punching Steps | Both Surfaces | Top Surface Side: 50 Back Surface Side: 60 | 35 | ○ | ○ |
| Comparative Example 1 | — | — | — | — | X | X |
| Comparative Example 2 | After First and Second Punching Steps | Back Surface | 26 | 25 | X | X |
| Comparative Example 3 | After First and Second Punching Steps | Back Surface | 63 | 35 | X | X |

The results shown in Table 1 demonstrate that in Examples 1 to 9, both the generation of burrs and the generation of metal powder were well suppressed as compared with Comparative Examples 1 to 3. Specifically, in Examples 3 to 7 wherein the back surface side opposite to the surface pressed by the punch in the second step punching processing was crushed in the swaging processing, both the generation of burrs and the generation of metal powder could be more satisfactorily suppressed. Among them, Examples 4 to 7 in which the degree of processing was increased were particularly satisfactory.

In Comparative Examples 2 and 3, the punched surface of the press-formed product after the punching processing had a defective shape due to the swaging processing performed after the first step punching processing and the second step punching processing.

The above results demonstrate that since Examples 1 to 9 carried out the swaging processing between the two punching processing steps, the generation of burrs and the generation of metal powder were effectively suppressed as compared with Comparative Examples 1 to 3.

DESCRIPTION OF REFERENCE NUMERALS

1*a* sheet material
1*b*, 11*b* press-formed product
2, 12 first step punched surface
2*a*, 12*a* shear surface region
2*b*, 12*b* fracture surface region
3, 13 second step punched surface
3*a*, 13*a* shear surface region
3*b*, 13*b* fracture surface region
4 scrap
5, 15 matching portion
5*a* matching portion forming portion
20 pressing member of swaging processing means
α inclined angle of inclined contact surface of pressing member
t thickness of sheet material
θ angle between back surface and fracture surface region on first step punched surface side at matching portion
TS top surface
BS back surface
PF pressing force

What is claimed is:

1. A punching processing method in which a metallic sheet material is sequentially subjected to multiple punching processing steps by at least one punch and at least one die, comprising the following steps in this order:

a first punching processing step of forming a first punched surface on the sheet material;

a swaging processing step that sandwiches and crushes one or more matching portion-forming portions of the sheet material from a top surface side and a back surface side of the sheet material, wherein the swaging processing step comprises pressing and crushing the matching portion-forming portions by a contact surface inclined at 30° to 85° relative to the top surface and the back surface of the sheet material; and, a second punching processing step of forming a second punched surface on the sheet material by punching the sheet material such that the second punched surface and the first punched surface intersect with each other, thereby forming one or more matching portions from the matching portion-forming portions at positions where the first punched surface and the second punched surface intersect.

2. The punching processing method according to claim 1, comprising, in the swaging processing step, sandwiching and crushing the matching portion-forming portions by pressing the matching portion-forming portions of the sheet material from the back surface side that is opposite to the top surface side of the sheet material, and in the second punching processing step, pressing the sheet material from the top surface side by a punch.

3. The punching processing method according to claim 2, wherein the swaging processing step comprises pressing and crushing at least one boundary portion between the back surface and the first step punched surface at the matching portion-forming portions.

4. The punching processing method according to claim 1, comprising carrying out the swaging processing step with a processing rate in a range of 30% to 90%, wherein the processing rate is a ratio of a thickness of the matching portion-forming portion after the swaging processing step to a thickness of the matching portion forming portion before the swaging processing step.

5. A method of manufacturing a press-formed product, comprising manufacturing the press-formed product using the punching processing method according to claim 1.

* * * * *